United States Patent [19]

Fickes et al.

[11] Patent Number: 5,062,533

[45] Date of Patent: Nov. 5, 1991

[54] BAG HOLDER FOR RECYCLABLE MATERIAL

[75] Inventors: William H. Fickes, 4503 Club House Dr., Marietta, Ga. 30066; Edward A. Fickes, Plano, Tex.

[73] Assignee: William H. Fickes, Marietta, Ga.

[21] Appl. No.: 584,458

[22] Filed: Sep. 18, 1990

[51] Int. Cl.[5] ..... B42F 17/00

[52] U.S. Cl. ..... 211/12; 248/95

[58] Field of Search ..... 248/95, 97, 99, 100, 248/101, 324, 339, 225.2, 227, 305; 211/12, 72; 220/404

[56] References Cited

U.S. PATENT DOCUMENTS

| | | | |
|---|---|---|---|
| 981,639 | 1/1911 | Hall | 248/100 |
| 3,779,496 | 12/1973 | Welles | 248/99 |
| 4,249,663 | 2/1981 | Hewlett | 211/12 X |
| 4,326,761 | 4/1982 | Schwartz | 211/72 X |
| 4,881,706 | 11/1989 | Sedlik | 248/99 |
| 4,925,056 | 5/1990 | McCoig | 248/95 X |
| 4,951,903 | 8/1990 | Frey | 248/99 |

FOREIGN PATENT DOCUMENTS

| | | | |
|---|---|---|---|
| 2221888 | 2/1990 | United Kingdom | 248/97 |

*Primary Examiner*—Ramon O. Ramirez

*Attorney, Agent, or Firm*—Thomas, Kerr & Kayden

[57] ABSTRACT

A bag holder for recyclable materials is disclosed, the holder having a body portion being adapted for mounting on a wall and having one or more bag securing stations. The stations utilize an aperture with a ring partially framing the aperture and adapted to pivot toward and away from the body portion. A portion of the bag is directed through the aperture and the ring, below the ring, and then back through the aperture, the weight of the bag serving to bias the ring toward the body portion and secure the bag therebetween.

15 Claims, 2 Drawing Sheets

BAG HOLDER FOR RECYCLABLE MATERIAL

BACKGROUND OF THE INVENTION

Limitations on the amount of natural resources in certain area, the limited space available for landfills, and the high costs of materials combine to make recycling of used materials both cost-efficient, if done on a relatively large scale, and, in some cases, a necessity Even where necessary; however, due to lack of landfill space for example, the efforts directed to recycling are normally directly related to the ease in which they may be accomplished Thus, where recycling is difficult, it is likely to be not done regardless of the consequences, i.e. increased trash removal fees, etc.

Recycling is becoming more widespread; however, due to increased public consciousness and, in some cases legislation mandating recycling and/or fines Presently available technology designed to ease recycling; however, is, in general, either cumbersome, or inconvenient to use. In some cases, trash removal services provide separate large receptacles for each recyclable commodity, i.e. newspaper, glass, cans, etc. These receptacles are then placed at curbside and collected by a municipality or private collection service at certain defined intervals, such as weekly, monthly, etc. In other cases, in-home bag stands are provided for each commodity, the relatively small bags then normally being transferred to larger bags for storage until being transported to a recycling center. Such bag stands normally take up considerable space without providing a large storage capacity and are thus inconvenient to use, especially since most such devices are designed for use in the kitchen area of the home.

SUMMARY OF THE INVENTION

It is, therefore, one of the principal objects of the present invention to provide a bag holder for recyclable materials that is convenient to use and is unobtrusive in such use.

Another object of the present invention is to provide a bag holder that can be mounted virtually anywhere and which may utilize receptacles of various sizes, depending on the particular needs of the user.

A further object of the present invention is to provide a holder which can be inexpensively produced and maintained and which is durable to provide a long service life.

These and other objects are attained by the present invention which relates to a holder for bags or similar receptacles for temporarily storing recyclable materials. The holder may have one or more stations, each having means for securing the receptacle until it is filled, removed, and transported to a recycling facility or, in some cases, to curbside. The present holder is preferably manufactured from plastic or other suitable, durable material and is designed so that securing or removing a bag is simple and easy to accomplish.

Various additional objects and advantages of the present invention will become apparent from the below description, with reference to the accompanying drawings.

DETAILED DESCRIPTION OF THE PREFERRED EMBODIMENT

Figure 2:
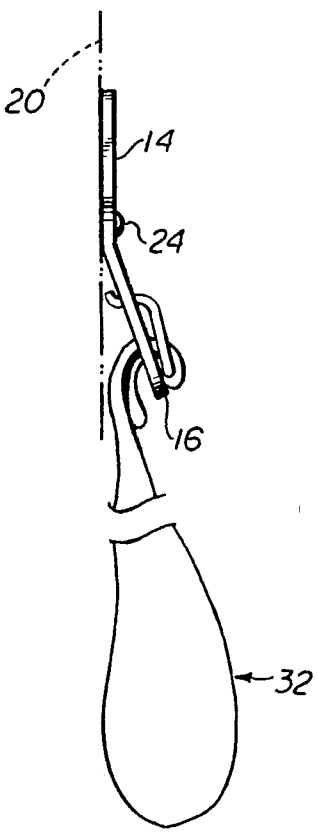
FIG. 2 is a side elevational view of the present holder, shown attached, to a wall and with a bag being secured thereby.
Figure 1:
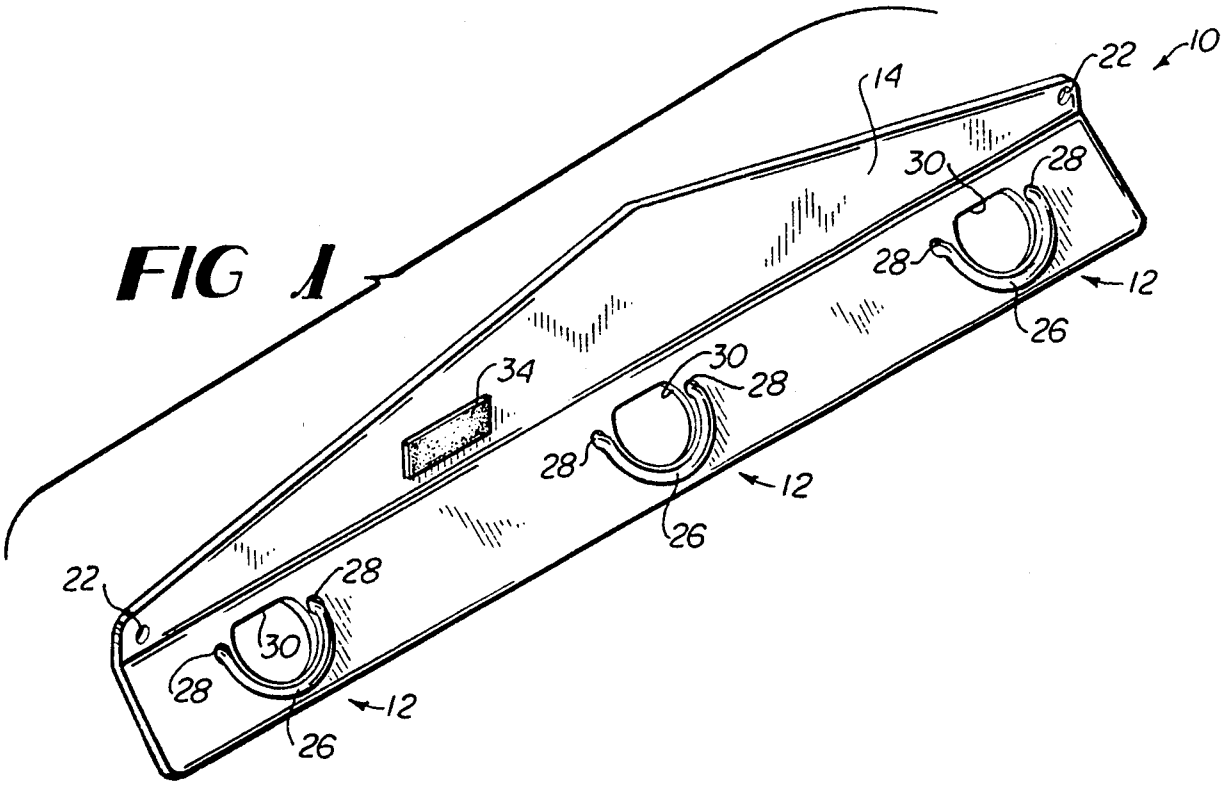
FIG. 1 is a perspective view of a first embodiment of the present bag holder.

Referring now more specifically to the drawings, and to FIG. 1 in particular, numeral 10 designates generally the present bag holder, shown in this embodiment with a plurality of stations 12 for suspending bags or similar receptacles. The holder 10 is normally in the form of a plate member and includes an upper, planar body portion 14 and a lower body portion 16, disposed at an angle to the upper portion. As shown in FIG. 2, the lower section extends outwardly from the mounting surface 20, so as to leave space between surface 20 and the lower portion 16 of the holder. The angle thus formed is normally less than 180° and is normally greater than 90°, with a preferred embodiment in the range of 135° to 170° in order to also present a relatively narrow profile. The angular disposition of the holder is necessary when using a rigid material for the body in order to leave space behind the holder when the holder is secured to a vertical surface such as a wall. The holder could also; however, be composed of a flexible material in which case it could be formed in a single plane and bent outwardly to secure a bag thereon.

Apertures 22 are provided in the upper section 14 of the holder for receiving screws 24 or other suitable fastening means. The holder may be fastened to a wall, inside a closet or pantry, or in any other convenient place and at a height sufficient to suspend a receptacle therefrom. The suspension means include a generally semicircular ring member 26, each end thereof being received in an aperture 28. The rings are loosely disposed in their respective apertures so as to have the ability to pivot toward and away from the lower portion 16 in which they are secured. The rings are thus able to bear against a bag secured between the inner side of the ring and the lower portion of the holder. The rings also partially frame the periphery of relatively large apertures 30, formed in the lower portion 16.

As illustrated in FIG. 2, to secure a bag 32, an upper portion of one side of the bag is gathered and passed through aperture 30 and ring 26 from the back side of the holder, utilizing the space left between the holder and the wall. The gathered portion of the bag is then passed below the ring 26 and then upwardly back through aperture 30. The weight of the bag thus biases the ring toward the holder with sufficient force to grip the bag therebetween and secure the bag in place. Tension on the ring is increased as the weight of the bag increases with added contents, thereby providing a secure mounting for the bag. When the bag is filled, the procedure for suspending the bag is reversed, and the bag is sealed and either transported to a recycling facility or placed at curbside for pick-up, utilizing the same bag that was suspended from the present holder.

Virtually any size bag may be used with the present holder and, due to the securing station design, handles for the bags are not required but may be utilized in the same manner as just described. Thus, the handle of the bag could be secured using the ring and the body of the holder, the handle being wound through the aperture 30 and ring 26 in serpentine fashion. The bags may be of any suitable material, preferably a biodegradable plastic or the like. Also included as a separating aid is a magnet 34 for separating steel and aluminum cans, the magnet being secured in any convenient place such as on the upper portion 14 of the holder.

Figure 3:
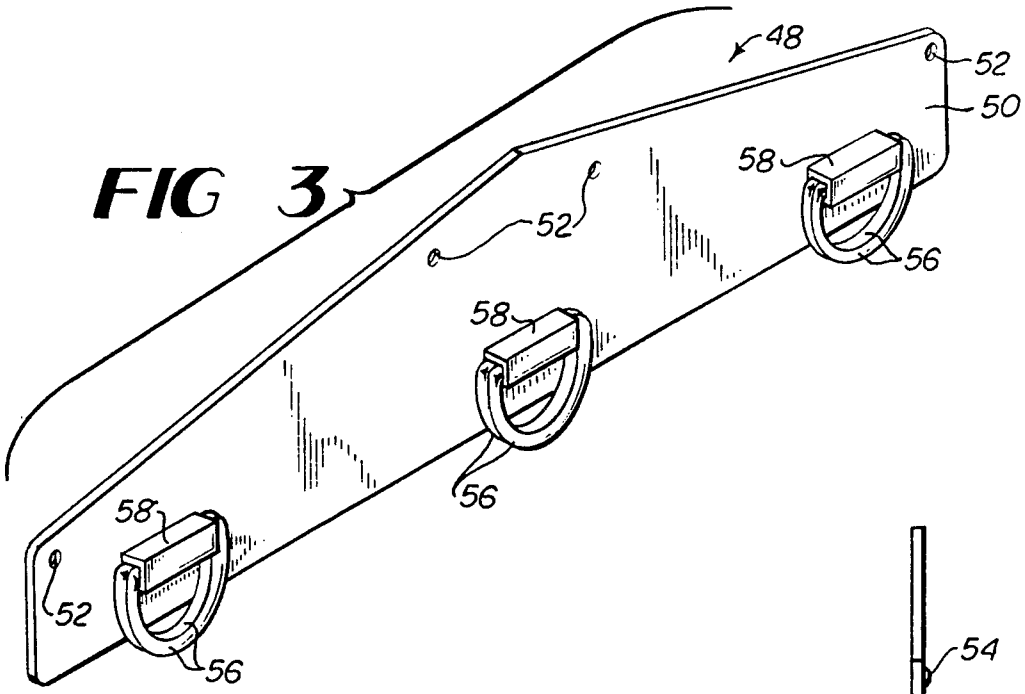
FIG. 3 is a perspective view of an alternate embodiment of invention.
Figure 4:
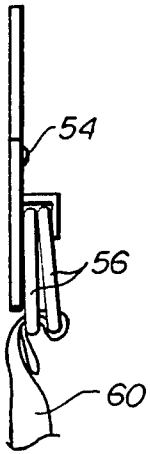
FIG. 4 a side elevational view of the embodiment shown in the figure, shown here attached to a wall and securing a bag.

An alternate embodiment 48 of the present holder is illustrated in FIGS. 3 and 4. The same basic principles apply as in the first described embodiment, the major difference being in the bag-securing means. This embodiment includes a generally planar, elongated body portion 50 having a plurality of apertures 52 formed therein for receiving screws 54 or other suitable securing means. The holder 48 may be mounted on a wall, door, etc. and/or in any convenient location and height for suspending receptacles therefrom.

Holder 48 includes a plurality of securing stations each comprising a pair of D-rings 56, suspended in side-by-side orientation from a mounting bracket means 58. The rings are loosely held by the bracket so as to be pivotable therefrom, thus providing a manipulable means for securing a bag or similar receptacle. Suspension of a bag 60 is illustrated in FIG. 4. One side of the upper, open end of the bag is gathered and is passed through both rings 56 from either side, in this case from the back. The gathered portion of the bag is then passed below the closest ring and through the adjacent ring as shown in FIG. 4. With this arrangement, the weight of the bag biases the bottom of the rings together, gripping the bag therebetween. Removal of the bag when it is full involves simply reversing the procedure, whereupon the bag is sealed and delivered to a recycler.

Figure 5:
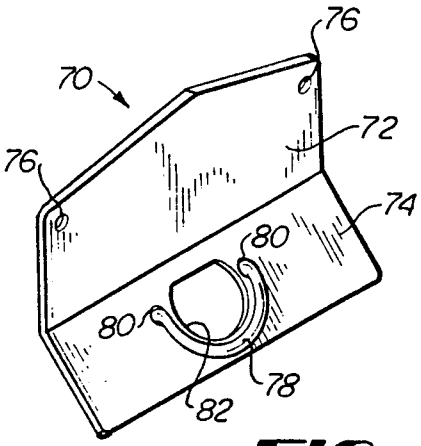
FIG. 5 is a perspective view of a third embodiment of the present invention, similar to that shown in FIG. 1 but having a single station.

The third embodiment of the holder 70, shown in FIG. 5, is similar to the embodiment of FIGS. 1 and 2. The holder 70 includes an upper planar portion 72, a lower portion 74 angularly disposed relative to the planar portion 72 and apertures 76 for receiving screws or the like for mounting the holder on a wall. The lower portion includes a single securing station having a generally semicircular ring member 78 mounted in suitable apertures 80. The ring member partially frames a relatively large aperture 82 through which the bag is inserted and engaged with the ring 78 as described hereinabove for the embodiment of FIGS. 1 and 2. This third embodiment is particularly suited for environments with limited space or where a single type of recyclable material, i.e. aluminum cans, is the only recyclable material used in that environment.

Thus, while an embodiment of a bag holder for recyclable materials and modifications thereof have been shown and described in detail herein, various additional changes and modifications may be made without departing from the scope of the present invention.

I claim:

1. A holder for suspending bags for collecting materials therein, comprising an upper body portion having a generally planar configuration and adapted for parallel securement to a generally vertical surface, a lower body portion extending angularly from said upper body portion and away from said vertical surface, and securing means on said lower body portion for receiving and securing a bag or the like, including an aperture formed in said lower body portion with a ring means disposed in close proximity to said aperture and adapted to pivot toward and away from said lower body portion for receiving a portion of a bag through said aperture and said ring means and between said ring means and said lower body portion.

2. A holder as defined in claim 1 in which said lower body portion is formed from a flexible material.

3. A holder as defined in claim 1 in which said upper body portion and said lower body portion form an angle within a range of ninety degrees to one hundred eighty degrees.

4. A holder as defined in claim 1 and including a plurality of said securing means.

5. A holder as defined in claim 3 in which said securing means include a pair of rings disposed adjacent one another and with each being secured to said lower body portion at one side of said rings with the opposite sides being movable toward and away from one another for receiving a portion of a bag therebetween in secured relationship thereto.

6. A holder as defined in claim 1 in which said securing means include a pair of rings disposed adjacent one another and with each being secured to said lower body portion at one side of said rings with the opposite sides being movable toward and away from one another for receiving a portion of a bag therebetween in secured relationship thereto.

7. A holder as defined in claim 1 and including a magnet secured to said upper body portion for separating magnetic material from non-magnetic material.

8. A bag holder for use in recycling used materials comprising a body member having a substantially planar configuration for mounting on a wall or the like and a securing means for suspending a receptacle therefrom for collecting recyclable materials, said securing means including a pair of ring means disposed adjacent one another and being secured to said body member at a common point, said ring means having free portions opposite the common securing point being movable toward and away from one another for receiving a portion of the receptacle in serpentine fashion.

9. A bag holder as defined in claim 3 in which said body member includes an upper planar portion and a lower portion angularly disposed relative to said upper portion and projecting away from the wall, said lower portion having an aperture formed therein with said aperture being partially framed by said ring member, said ring member being pivotally mounted for bearing against a portion of the receptacle, securing the receptacle between said ring member and said lower portion utilizing the weight of the receptacle to pivot said ring member toward said lower portion.

10. A bag holder as defined in claim 9 in which said holder includes a plurality of separate apertures and corresponding ring members for securing multiple receptacles.

11. A bag holder as defined in claim 8 and including a magnet secured to said upper body portion for separating magnetic material from non-magnetic material.

12. A bag holder for use in recycling used materials comprising an elongated plate member having an upper portion adapted for mounting on a generally vertical surface, a lower portion angularly disposed relative to said upper portion for providing space between said lower portion and the vertical surface, said lower portion having at least one bag securing station, said station having an aperture with a ring member disposed around the lower periphery of said aperture, said ring member being pivotally mounted to said lower portion with an upper portion of the bag being received through said aperture and said ring member, below said ring member and back through said aperture such that the weight of the bag biases said ring member toward said lower portion, securing the bag therebetween.

13. A bag holder as defined in claim 12 and including a plurality of securing stations each for holding a separate bag for receiving various recyclable materials.

14. A holder as defined in claim 13 in which said upper body portion and said lower body portion form an angle within a range of ninety degrees to one hundred eighty degrees.

15. A holder as defined in claim 12 in which said upper body portion and said lower body portion form an angle within a range of ninety degrees to one hundred eighty degrees.

* * * * *